US007980820B2

(12) United States Patent
Gayman et al.

(10) Patent No.: US 7,980,820 B2
(45) Date of Patent: Jul. 19, 2011

(54) TURBINE ENGINE BLADE COOLING

(75) Inventors: Scott W. Gayman, Manchester, CT (US); Justin D. Piggush, Hartford, CT (US); Edward F. Pietraszkiewicz, Southington, CT (US); William A. Agli, III, Meriden, CT (US)

(73) Assignee: United Technologies Corporation, Hartford, CT (US)

( * ) Notice: Subject to any disclaimer, the term of this patent is extended or adjusted under 35 U.S.C. 154(b) by 995 days.

(21) Appl. No.: 11/845,418

(22) Filed: Aug. 27, 2007

(65) Prior Publication Data

US 2009/0060741 A1 Mar. 5, 2009

(51) Int. Cl.
*F01D 5/18* (2006.01)

(52) U.S. Cl. ..... 416/97 R; 416/228; 416/241 R; 427/282

(58) Field of Classification Search ..... 415/115; 416/97 R, 241 R, 241 B, 228; 427/272, 282, 427/287

See application file for complete search history.

(56) References Cited

U.S. PATENT DOCUMENTS 4,390,320 A * 6/1983 Eiswerth ..... 416/97 R
4,743,462 A * 5/1988 Radzavich et al. ..... 427/448
5,733,102 A * 3/1998 Lee et al. ..... 416/97 R
6,335,078 B2 * 1/2002 Venkataramani et al. .... 428/139
6,383,602 B1 * 5/2002 Fric et al. ..... 428/131
2005/0084657 A1 * 4/2005 Ohara ..... 428/195.1

OTHER PUBLICATIONS

Bunker, Ronald S., "Gas Turbine Heat Transfer: 10 Remaining Hot Gas Path Challenges," Proceedings of GT2006, ASME Turbo Expo 2006: Power for Land, Sea and Air, May 8-11, 2006, Barcelona, Spain.

* cited by examiner

*Primary Examiner* — Ninh H Nguyen

(74) *Attorney, Agent, or Firm* — Carlson, Gaskey & Olds PC

(57) ABSTRACT

A blade is provided for a turbine engine that includes an exterior surface. The exterior surface includes a portion having a thermal barrier coating and an uncoated shelf adjacent to the thermal barrier coating without the thermal barrier coating. A cooling hole extends from an internal passageway through the exterior surface to an exit. A scarfed channel is recessed in the exterior surface and interconnected to the cooling hole at the exit. The scarfed channel extends to a blade tip end surface. The scarfed channel protects the cooling fluid exiting the cooling hole from secondary flows surrounding the blade that would otherwise mix with and disperse the cooling fluid. The scarfed channels also increase the surface area exposed to the cooling fluid to increase the heat transfer rate.

16 Claims, 4 Drawing Sheets

TURBINE ENGINE BLADE COOLING

BACKGROUND

This application relates to turbine engine blades. More particularly, the application relates to thermal barrier coatings and cooling holes for use with turbine engine blades.

High heat loads exist between the tip of a turbine engine blade and its shroud. The tip temperature for a high pressure turbine blade, for example, can be a limiting factor in the design and operation of a turbine engine. As a result, efforts are made to reduce the temperatures at the blade tip.

One prior art tip cooling approach uses a thermal barrier coating at the tip to reduce the heat flux at the tip. Another approach provides tip cooling holes that apply a film of cooling fluid in the vicinity of the tip. Another approach is to provide machined pockets at the tip to reduce heat transfer in the area, retain the cooling flows and reduce the volume of metal at the tip that needs to be cooled. One or more of these cooling approaches may be applied to a particular blade to achieve lower blade tip temperatures.

Despite the use of the approaches described above, undesirably high tip temperatures exist. Heat loads within the pocket are typically higher than desired. External surfaces are typically covered with thermal barrier coatings to reduce the heat flux. However, lower metal temperatures can be achieved by removing the thermal barrier coating at the tip, which forms a shelf that increases film effectiveness in the area. While this has been achieved in the prior art, it is unknown what techniques have been employed to provide the shelf. What is needed is a further reduction in blade tip temperature.

SUMMARY

A blade is provided for a turbine engine that includes an exterior surface. The exterior surface includes a portion having a thermal barrier coating and an uncoated shelf adjacent to the thermal barrier coating without the thermal barrier coating. A cooling hole extends from an internal passageway, which is spaced from the exterior surface, through the exterior surface to an exit. A scarfed channel is recessed in the exterior surface and interconnected to the cooling hole at the exit. The scarfed channel extends to a blade tip end surface. The scarfed channel protects the cooling fluid exiting the cooling hole from secondary flows surrounding the blade that would otherwise mix with and disperse the cooling fluid. The scarfed channels also increase the surface area exposed to the cooling fluid to increase the heat transfer rate.

In one example, the exterior surface of the blade is masked using a mask, which provides a masked area. The thermal barrier coating is applied to the exterior surface to an unmasked area. The mask is removed to reveal the masked area, which does not have the thermal barrier coating material. In one example, the scarfed channels are machined into the exterior surface subsequent to the masking step.

These and other features of the application can be best understood from the following specification and drawings, the following of which is a brief description.

DETAILED DESCRIPTION OF THE PREFERRED EMBODIMENT

Figure 1:
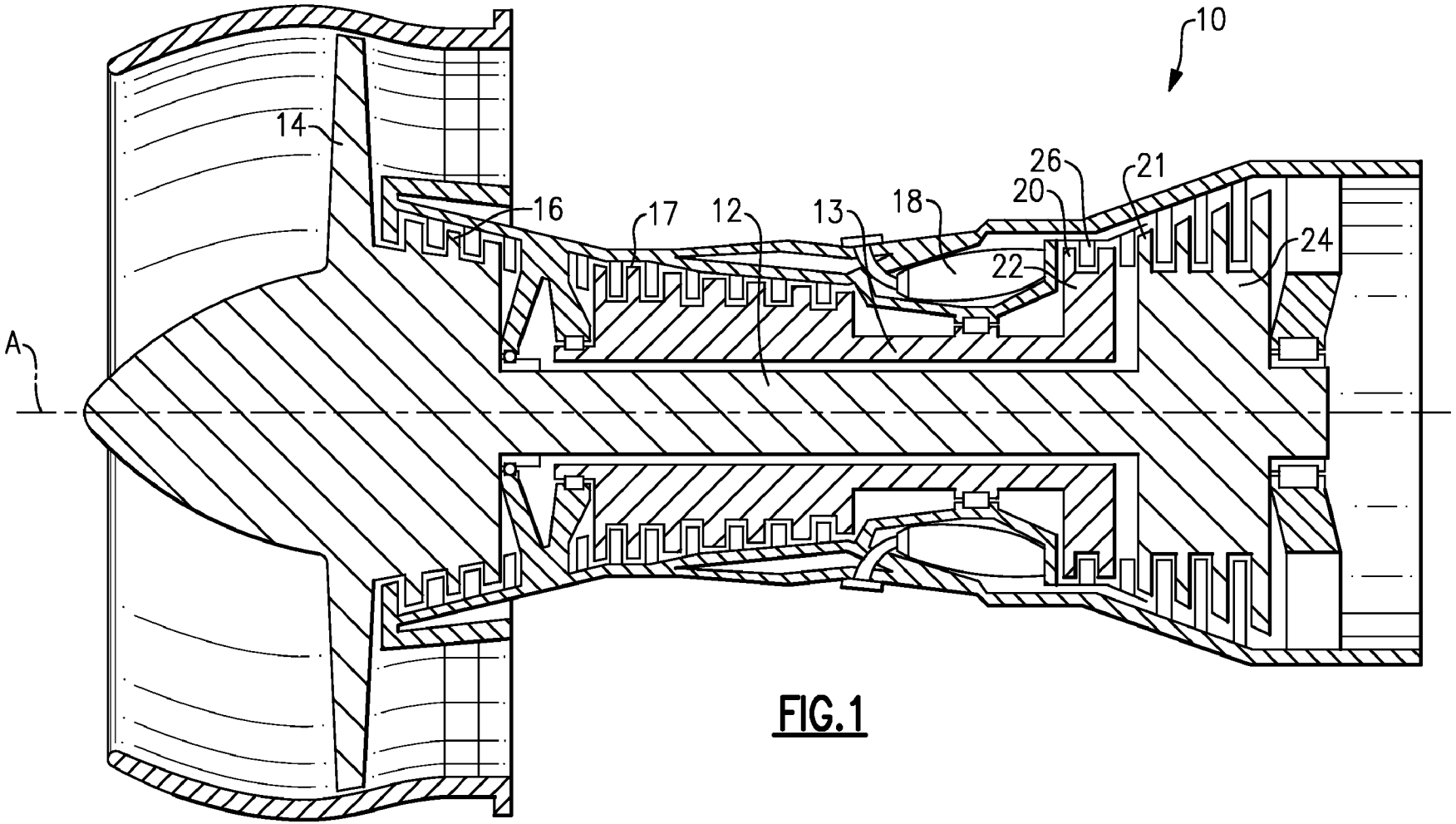
FIG. 1 is a cross-sectional view of one type of turbine engine.

One example turbine engine 10 is shown schematically in FIG. 1. As known, a fan section moves air and rotates about an axis A. A compressor section, a combustion section, and a turbine section are also centered on the axis A. FIG. 1 is a highly schematic view, however, it does show the main components of the gas turbine engine. Further, while a particular type of gas turbine engine is illustrated in this figure, it should be understood that the claim scope extends to other types of gas turbine engines.

The engine 10 includes a low spool 12 rotatable about an axis A. The low spool 12 is coupled to a fan 14, a low pressure compressor 16, and a low pressure turbine 24. A high spool 13 is arranged concentrically about the low spool 12. The high spool 13 is coupled to a high pressure compressor 17 and a high pressure turbine 22. A combustor 18 is arranged between the high pressure compressor 17 and the high pressure turbine 22.

The high pressure turbine 22 and low pressure turbine 24 typically each include multiple turbine stages. A hub supports each stage on its respective spool. Multiple turbine blades are supported circumferentially on the hub. High pressure and low pressure turbine blades 20, 21 are shown schematically at the high pressure and low pressure turbine 22, 24. Stator blades 26 are arranged between the different stages.

Figure 2:
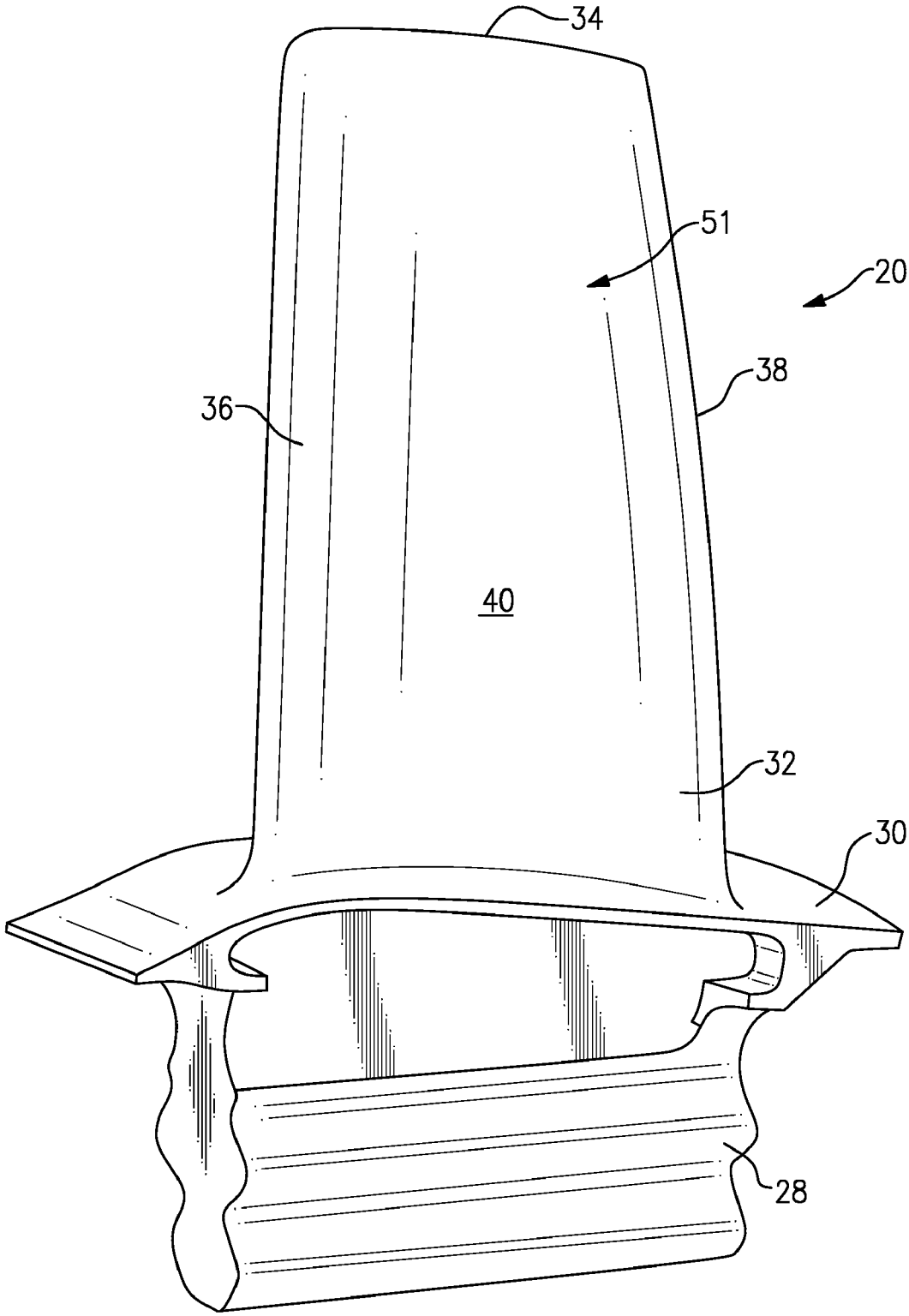
FIG. 2 is a perspective view of an example turbine blade.
Figure 3A:
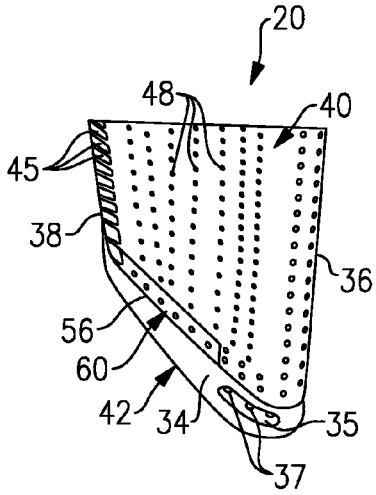
FIG. 3A is a perspective end view of the blade shown in FIG. 2.

An example high pressure turbine blade 20 is shown in more detail in FIG. 2. It should be understood, however, that the example cooling passage can be applied to other blades, such as compressor blades, stator blades and low pressure turbine blades. The example blade 20 includes a root 28 that is secured to the turbine hub. Typically, a cooling flow, for example from a compressor stage, is supplied at the root 28 to cooling passages within the blade 20 to cool the airfoil. The blade 20 includes a platform 30 supported by the root 28 with a blade portion 32, which provides the airfoil, extending from the platform 30 to a tip 34. The blade 20 includes a leading edge 36 at the inlet side of the blade 20 and a trailing edge 38 at its opposite side. Referring to FIGS. 2 and 3A, the blade 20 includes a suction side provided by a convex surface and a pressure side 40 provided by a concave surface opposite of the suction side.

Figure 3B:
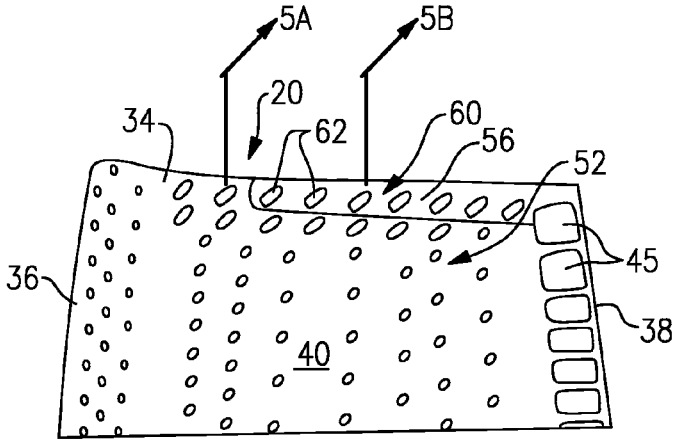
FIG. 3B is a pressure side view of the blade shown in FIG. 3A.

Referring to FIGS. 3A and 3B, the pressure side 40 and tip 34 of the blade 20 are shown in more detail. The blade 20 includes a thermal barrier coating 52 on a portion of the blade 20 and a shelf 56 adjacent to the thermal barrier coating 52 near the tip 34. The shelf 56 is an exposed area of the underlying metal exterior surface, which enables cooling fluid to contact and better cool that tip region.

Figure 4:
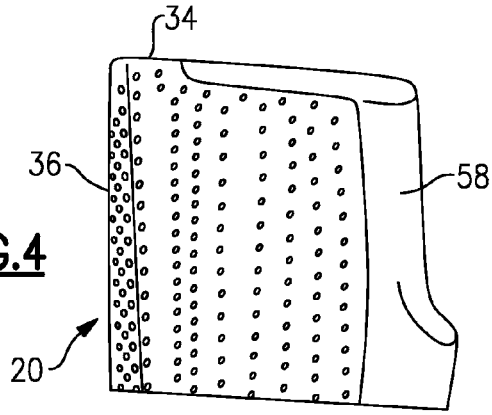
FIG. 4 is a view of the blade shown in FIG. 3B during masking.

One example method of providing the shelf 56 is shown in FIG. 4. Referring to FIG. 4, a mask 58 is aligned with the tip 34 and trailing edge 38 hidden by mask 58 (in FIG. 4) to prevent the application of the thermal barrier coating 52 to the masked areas 60 defined by the mask 58. Once the thermal barrier coating 52 has been applied the mask 58 can be removed and the blade 20 may receive subsequent machining if desired. The thermal barrier coating 52 could also be mechanically removed from the blade 20 wherever it is undesired.

Figure 5A:
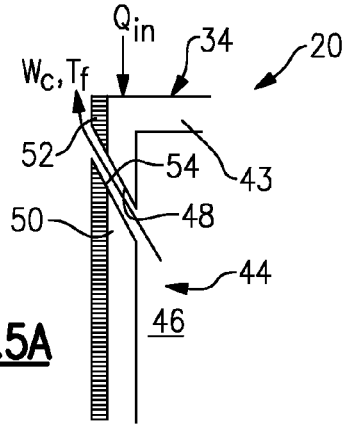
FIG. 5A is a cross-sectional view of the blade shown in FIG. 3B in an unmasked area taken along line 5A.
Figure 5B:
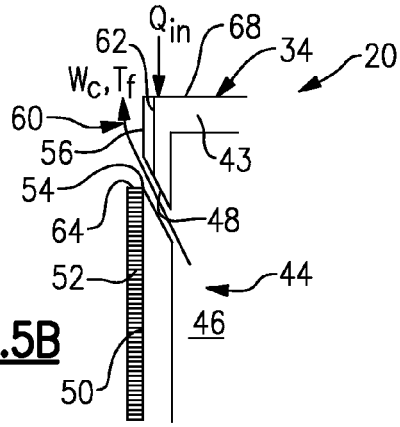
FIG. 5B is a cross-sectional view of the blade shown in FIG. 3B in a masked area taken along line 5B.

Returning to FIGS. 3A and 3B, the tip 34 includes a recess 35 having cooling apertures 37 in communication with a cooling passage internal to the blade 20. The recess 35 including apertures 37 may supplement the cooling of the tip 34 provided by the shelf 56. Referring to FIGS. 5A-5B, the blade 20 includes structure 43 providing an internal cooling passage 44. The cooling passage 44 provides cooling fluid to a passageway 46 that is in communication with multiple cooling holes 48, best seen in FIGS. 3A and 3B. The cooling holes 48 extend from the passageway 46 through the structure 43 to an exterior surface 50 at an exit 54.

A transition 64 is provided between the masked area (FIG. 5B), which separates the shelf 56 and the thermal barrier coating 52. In one example, the exit 54 is arranged near the transition 64. In the example shown in FIG. 5B, the exit 54 extends to the shelf 56. A scarfed channel 62, which can be machined after masking for example, is recessed in the exterior surface 50 and extends from the exit 54 to a tip end surface 68 provided on the tip 34. The tip end surface 68 is generally perpendicular to the exterior surface 50 and generally planar in shape. Providing the scarfed channels 62 that extend to the tip end surface 68 better ensures that cooling fluid is delivered to the tip 34 without becoming undesirably dispersed. As a result, the cooling fluid can more effectively cool the tip 34.

Figure 6:
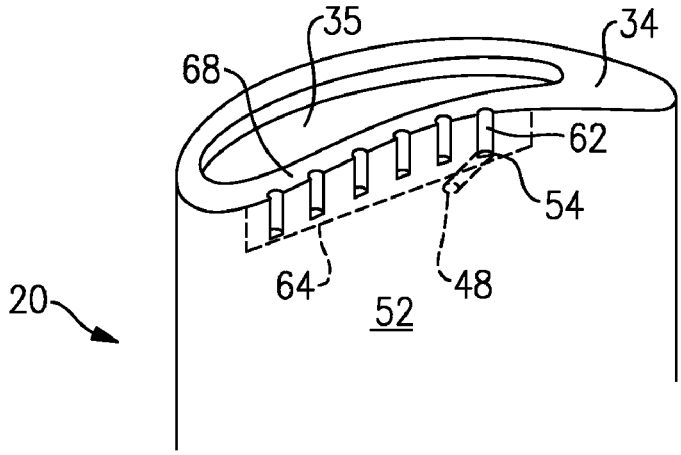
FIG. 6 is a schematic perspective view of a blade illustrating scarfed channels extending to a blade tip end surface.

The scarfed channels 62, shown in FIGS. 3A and 3B, flare out and decrease in depth as they extend away from the exit 54. The scarfed channels 62, shown in FIG. 6, are more uniform in depth and width as they extend from the exit 54. The scarfed channels 62 can be any desired shape.

Figure 7:
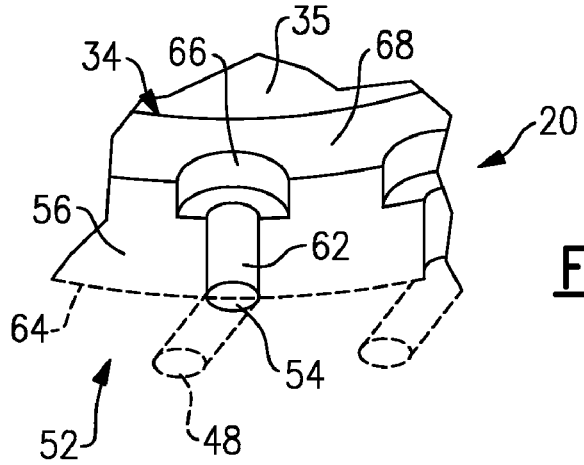
FIG. 7 is an enlarged view of a blade in the area of the tip illustrating another type of scarfed channel.
Figure 8:
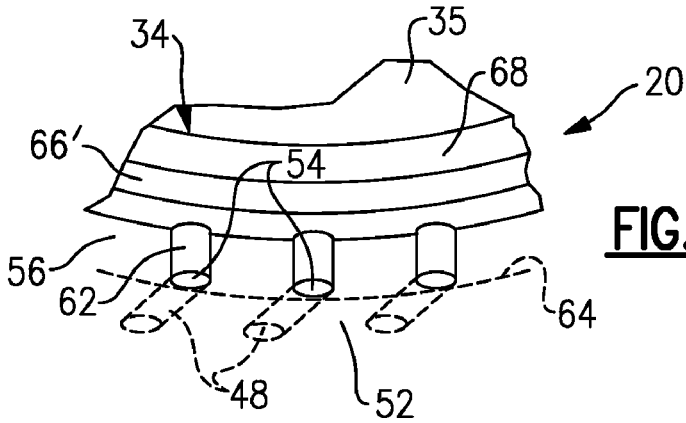
FIG. 8 is an enlarged view illustrating yet another typing of scarfed channel.

Referring to FIG. 7, the scarfed channel 62 includes a tip groove 66 that is spaced from the exit 54 and extends to the tip end surface 68 to increase the surface area exposed to the cooling fluid. In the example shown in FIG. 7, each cooling hole 48 includes a discrete tip groove 66. Referring to FIG. 8, the tip groove 66' extends between or bridges multiple scarfed channels 62 that are associated with separate cooling holes 48.

Although a preferred embodiment has been disclosed, a worker of ordinary skill in this art would recognize that certain modifications would come within the scope of the claims. For that reason, the following claims should be studied to determine their true scope and content.

What is claimed is:

1. A blade for a turbine engine comprising:

an exterior surface including a portion having a thermal barrier coating and an uncoated shelf adjacent to the thermal barrier coating without the thermal barrier coating;

a cooling hole extending through the exterior surface at an exit; and a scarfed channel recessed in the exterior surface and interconnected to the cooling hole at the exit, the scarfed channel extending to a blade tip end surface.

2. The blade according to claim 1, wherein the scarfed channel is wider than the exit.

3. The blade according to claim 1, wherein the scarfed channel includes a tip groove spaced from the exit and extending to the blade tip end surface.

4. The blade according to claim 3, wherein the tip groove runs along the blade tip end surface and interconnects multiple scarfed channels.

5. The blade according to claim 1, wherein the blade tip end surface is arranged transverse to the exterior surface.

6. The blade according to claim 5, wherein the blade tip end surface is generally perpendicular to the exterior surface and generally planar in shape.

7. The blade according to claim 1, wherein the scarfed channel begins in the uncoated shelf and extends to the blade tip end surface.

8. The blade according to claim 1, wherein a transition separates the thermal barrier coating and the uncoated shelf, the exit arranged near the transition.

9. The blade according to claim 8, wherein the exit is at the uncoated shelf.

10. The blade according to claim 1, wherein the exterior surface provides a pressure side of the blade.

11. A method of manufacturing a blade for a turbine engine comprising the steps of:

masking an exterior surface of a blade to cover multiple cooling channels with a single mask to provide a masked area;

applying a thermal barrier coating to an unmasked area of the blade; and removing the mask to reveal the masked area, the masked area without the thermal barrier coating.

12. The method according to claim 11, wherein the masking step includes aligning the mask with a blade tip.

13. The method according to claim 11, wherein the applying step includes forming a transition between the thermal barrier coating and the masked area.

14. The method according to claim 11, comprising providing cooling holes in the masked area.

15. The method according to claim 11, wherein the masked area extends along a tip and a trailing edge of the blade, the single mask covering multiple cooling channels along the tip and the trailing edge.

16. A method of manufacturing a blade for a turbine engine comprising the steps of:

masking an exterior surface of a blade with a mask to provide a masked area;

applying a thermal barrier coating to an unmasked area of the blade;

removing the mask to reveal the masked area, the masked area without the thermal barrier coating;

providing cooling holes in the masked area; and wherein the providing step includes providing a scarfed channel in the exterior surface extending between the cooling holes and the blade tip.

* * * * *